US011383878B2

(12) United States Patent
Frost

(10) Patent No.: US 11,383,878 B2
(45) **Date of Patent: *Jul. 12, 2022**

(54) BOX CONTAINER AND DISPLAY

(71) Applicant: Vanguard Packaging, LLC, Kansas City, MO (US)

(72) Inventor: Jerry Ryan Frost, Kansas City, MO (US)

(73) Assignee: VANGUARD PACKAGING, LLC, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/872,308

(22) Filed: May 11, 2020

(65) Prior Publication Data

US 2020/0270014 A1 Aug. 27, 2020

Related U.S. Application Data

(63) Continuation of application No. 15/596,381, filed on May 16, 2017, now Pat. No. 10,647,468, which is a (Continued)

(51) Int. Cl.
*B65D 5/50* (2006.01)
*B65D 5/32* (2006.01)

(Continued)

(52) U.S. Cl.
CPC ..... *B65D 5/5023* (2013.01); *B65D 5/324* (2013.01); *B65D 5/4266* (2013.01); *B65D 5/445* (2013.01); *B65D 5/505* (2013.01); *B31B 2105/00* (2017.08)

(58) Field of Classification Search
CPC ..... B65D 5/324; B65D 5/445; B65D 5/5023; B65D 5/505; B65D 5/4266

(Continued)

(56) References Cited

U.S. PATENT DOCUMENTS 2,421,225 A * 5/1947 Stensgaard ..... B65D 9/38 229/198.1
2,578,060 A 12/1951 Grant (Continued)

FOREIGN PATENT DOCUMENTS

CA 2693596 A1 1/2009
DE 3824930 A1 1/1990

(Continued)

OTHER PUBLICATIONS

"Final Office Action received for U.S. Appl. No. 15/596,381, dated Mar. 15, 2018".

(Continued)

*Primary Examiner* — Christopher R Demeree
(74) *Attorney, Agent, or Firm* — Kutak Rock LLP

(57) ABSTRACT

A corrugated box container with a main component including a base section and first and second side sections. The box container additionally includes first and second side support components associated with the first and second side sections for reinforcing the first and second side support sections. The box container further includes a cover component that is capable of engagement with the main component or the first and second side support components, such that the main component and the cover component present a fully enclosed space within the box container. The box container is erected from a knockdown configuration by folding the first and second side sections until the side sections are generally perpendicular with the base section; connecting the first and second side support components with the first and second side sections respectively; and connecting the cover component with the main component or the first and second side support components.

10 Claims, 7 Drawing Sheets

Related U.S. Application Data continuation of application No. 14/997,685, filed on Jan. 18, 2016, now Pat. No. 9,682,795, which is a continuation of application No. 13/955,925, filed on Jul. 31, 2013, now Pat. No. 9,238,523, application No. 16/872,308, which is a continuation of application No. 16/505,137, filed on Jul. 8, 2019, now Pat. No. 11,013,349, which is a continuation of application No. 15/960,338, filed on Apr. 23, 2018, now Pat. No. 10,342,365, which is a continuation of application No. 13/955,865, filed on Jul. 31, 2013, now Pat. No. 9,949,579, application No. 16/872,308, which is a continuation of application No. 15/952,928, filed on Apr. 13, 2018, now Pat. No. 10,699,602, which is a continuation of application No. 14/679,586, filed on Apr. 6, 2015, now Pat. No. 9,947,245, which is a continuation of application No. 13/955,811, filed on Jul. 31, 2013, now Pat. No. 8,997,388, application No. 16/872,308, which is a continuation of application No. 16/520,270, filed on Jul. 23, 2019, now abandoned, which is a continuation of application No. 15/956,575, filed on Apr. 18, 2018, now Pat. No. 10,390,634, which is a continuation of application No. 15/363,256, filed on Nov. 29, 2016, now Pat. No. 9,986,856, which is a continuation of application No. 14/968,352, filed on Dec. 14, 2015, now Pat. No. 9,578,978, which is a continuation of application No. 14/146,130, filed on Jan. 2, 2014, now Pat. No. 9,212,019, application No. 16/872,308, which is a continuation of application No. 15/912,180, filed on Mar. 5, 2018, now Pat. No. 10,696,450, which is a continuation of application No. 15/369,574, filed on Dec. 5, 2016, now Pat. No. 9,908,663, which is a continuation of application No. 14/216,274, filed on Mar. 17, 2014, now Pat. No. 9,511,899, application No. 16/872,308, which is a continuation of application No. 16/236,920, filed on Dec. 31, 2018, now Pat. No. 10,825,362, which is a continuation of application No. 15/790,692, filed on Oct. 23, 2017, now Pat. No. 10,170,021, which is a continuation of application No. 14/840,417, filed on Aug. 31, 2015, now Pat. No. 9,799,239, which is a continuation of application No. 14/216,721, filed on Mar. 17, 2014, now Pat. No. 9,123,262, application No. 16/872,308, which is a continuation of application No. 15/687,791, filed on Aug. 28, 2017, now Pat. No. 10,687,636, which is a continuation of application No. 14/595,988, filed on Jan. 13, 2015, now Pat. No. 9,743,782.

(60) Provisional application No. 61/677,979, filed on Jul. 31, 2012, provisional application No. 61/677,966, filed on Jul. 31, 2012, provisional application No. 61/677,937, filed on Jul. 31, 2012, provisional application No. 61/748,672, filed on Jan. 3, 2013, provisional application No. 61/793,340, filed on Mar. 15, 2013, provisional application No. 61/791,437, filed on Mar. 15, 2013, provisional application No. 61/926,805, filed on Jan. 13, 2014.

(51) Int. Cl.

| | |
|---|---|
| ***B65D 5/42*** | (2006.01) |
| ***B65D 5/44*** | (2006.01) |
| ***B31B 105/00*** | (2017.01) |

(58) Field of Classification Search

USPC ..... 229/122.21, 122.24, 122.26, 122.32, 229/125.19, 125.27, 125.28, 164, 199, 229/167; 206/736, 774

See application file for complete search history.

(56) References Cited

U.S. PATENT DOCUMENTS

| | | | | |
|---|---|---|---|---|
| 2,609,136 | A | 9/1952 | Sider | |
| 2,798,685 | A | 7/1957 | Mooney | |
| 2,918,178 | A | 12/1959 | Leone | |
| 3,195,798 | A | 7/1965 | Wilson | |
| 3,272,419 | A * | 9/1966 | Vineberg | B65D 5/324 229/122.23 |
| 3,362,610 | A | 1/1968 | Dyke | |
| 3,744,700 | A | 7/1973 | Stegmann | |
| 3,987,737 | A | 10/1976 | Smith | |
| 4,050,386 | A | 9/1977 | Kellogg | |
| 4,102,276 | A | 7/1978 | Roveroni | |
| 4,143,763 | A | 3/1979 | Haglund | |
| 4,248,350 | A | 2/1981 | Gilbert | |
| 4,306,675 | A | 12/1981 | Swanson | |
| 4,341,338 | A | 7/1982 | Arnold | |
| 4,383,636 | A | 5/1983 | Chaffers | |
| 4,427,108 | A | 1/1984 | Coles et al. | |
| 4,458,838 | A | 7/1984 | Lacasa et al. | |
| 4,506,790 | A | 3/1985 | Muscari | |
| 4,567,996 | A | 2/1986 | Muise | |
| 4,638,745 | A | 1/1987 | Sheffer | |
| 4,646,922 | A | 3/1987 | Smith | |
| 4,709,852 | A | 12/1987 | Stoll | |
| 4,863,024 | A | 9/1989 | Booth | |
| 4,871,067 | A | 10/1989 | Valenti | |
| 4,889,252 | A | 12/1989 | Rockom et al. | |
| 4,911,355 | A | 3/1990 | Bannister | |
| 4,932,533 | A | 6/1990 | Collier | |
| 4,969,595 | A | 11/1990 | Teasdale | |
| 5,016,545 | A | 5/1991 | Robertson et al. | |
| 5,145,244 | A | 9/1992 | Kersting et al. | |
| 5,190,211 | A | 3/1993 | Stoddard et al. | |
| 5,193,466 | A | 3/1993 | Eder | |
| 5,213,220 | A | 5/1993 | Mcbride | |
| 5,226,571 | A | 7/1993 | Eastwood et al. | |
| 5,253,769 | A | 10/1993 | Vlastakis | |
| 5,277,360 | A | 1/1994 | Demott | |
| 5,301,800 | A | 4/1994 | Kenney | |
| 5,312,034 | A | 5/1994 | Nakagawa et al. | |
| 5,316,210 | A | 5/1994 | Scullin | |
| D348,000 | S | 6/1994 | Strasevicz et al. | |
| 5,318,789 | A | 6/1994 | Nakagawa et al. | |
| 5,322,212 | A | 6/1994 | Strasevicz et al. | |
| 5,333,777 | A | 8/1994 | Roth | |
| D352,235 | S | 11/1994 | Strasevicz et al. | |
| 5,579,991 | A | 12/1996 | Strasevicz et al. | |
| 5,702,011 | A | 12/1997 | Carroll | |
| 5,706,959 | A | 1/1998 | Smith | |
| RE35,875 | E | 8/1998 | Shuert | |
| 5,826,732 | A | 10/1998 | Ragsdale | |
| 5,966,857 | A | 10/1999 | Pettersson et al. | |
| 6,068,140 | A | 5/2000 | Mangrum et al. | |
| 6,126,254 | A | 10/2000 | Maglione | |
| 6,155,441 | A | 12/2000 | Andersen et al. | |
| 6,168,073 | B1 | 1/2001 | Towle | |
| 6,283,363 | B1 * | 9/2001 | Focke | B65B 5/028 229/125.19 |
| 6,347,772 | B1 | 2/2002 | L'Hotel | |
| 6,378,710 | B1 | 4/2002 | Grueneberg | |
| 6,440,050 | B1 | 8/2002 | Capparelli | |
| 6,508,023 | B2 | 1/2003 | Moss et al. | |
| 6,581,772 | B2 | 6/2003 | Noland | |
| 6,612,669 | B2 | 9/2003 | Grueneberg | |
| 6,715,623 | B2 | 4/2004 | Broerman | |
| 7,007,615 | B2 | 3/2006 | Grueneberg | |
| 7,066,342 | B2 | 6/2006 | Baechle et al. | |
| 7,111,735 | B2 | 9/2006 | Lowry | |
| 7,137,517 | B2 | 11/2006 | Lowry et al. | |
| 7,252,200 | B1 | 8/2007 | Hester | |
| 7,281,648 | B2 | 10/2007 | Lowry | |

(56) References Cited

U.S. PATENT DOCUMENTS

| | | | | |
|---|---|---|---|---|
| 7,284,662 | B2 | 10/2007 | DeBusk et al. | |
| 7,546,927 | B2 | 6/2009 | Lowry et al. | |
| 7,634,865 | B2 | 12/2009 | L'Hôtel | |
| 7,677,433 | B2 | 3/2010 | Little | |
| 7,681,735 | B2 | 3/2010 | Youell, Jr. et al. | |
| 7,703,864 | B2 | 4/2010 | Moser | |
| 7,708,187 | B2 | 5/2010 | Keefe, Jr. et al. | |
| 7,810,707 | B2 | 10/2010 | Little | |
| 7,819,305 | B2 | 10/2010 | Little | |
| 7,861,916 | B2 | 1/2011 | Little | |
| 7,981,017 | B2 | 7/2011 | Little et al. | |
| 8,281,981 | B2 | 10/2012 | Foden | |
| 8,459,190 | B2 | 6/2013 | Erdie | |
| 8,596,518 | B2 | 12/2013 | Babcock | |
| 8,740,054 | B2 | 6/2014 | Pinkstone | |
| 8,763,888 | B2 | 7/2014 | Willman et al. | |
| 9,126,721 | B2 | 9/2015 | Dye et al. | |
| 9,238,523 | B1 | 1/2016 | Frost | |
| 9,511,899 | B1 | 12/2016 | Valentini et al. | |
| 9,682,795 | B1 | 6/2017 | Frost | |
| 9,743,782 | B1 | 8/2017 | Frost | |
| 9,783,333 | B1 | 10/2017 | De Los et al. | |
| 9,908,663 | B1 | 3/2018 | Valentini et al. | |
| 9,994,356 | B2 * | 6/2018 | Couture | B65D 5/5445 |
| 10,081,470 | B2 * | 9/2018 | Weaver | B65B 21/242 |
| 10,329,046 | B2 | 6/2019 | Smith | |
| 10,472,123 | B2 * | 11/2019 | Little | B65D 5/4279 |
| 10,513,368 | B2 | 12/2019 | Iwahara et al. | |
| 10,647,468 | B2 | 5/2020 | Jerry | |
| 10,687,636 | B2 | 6/2020 | Frost | |
| 10,696,450 | B2 | 6/2020 | Valentini et al. | |
| 10,919,677 | B2 * | 2/2021 | Chevalier | B65D 5/321 |
| 2002/0108541 | A1 | 8/2002 | Grueneberg | |
| 2003/0160015 | A1 | 8/2003 | Broerman | |
| 2004/0118742 | A1 | 6/2004 | Shuert | |
| 2005/0067321 | A1 | 3/2005 | Pitts et al. | |
| 2006/0157380 | A1 | 7/2006 | Lowry et al. | |
| 2007/0095767 | A1 | 5/2007 | Henke et al. | |
| 2008/0030113 | A1 | 2/2008 | Vail | |
| 2008/0083682 | A1 | 4/2008 | Moss et al. | |
| 2008/0169340 | A1 | 7/2008 | Sheffer | |
| 2009/0286663 | A1 | 11/2009 | Little et al. | |
| 2010/0006629 | A1 | 1/2010 | Bettinger et al. | |
| 2010/0083618 | A1 | 4/2010 | Little | |
| 2010/0087304 | A1 | 4/2010 | Little | |
| 2010/0108748 | A1 | 5/2010 | Fleming et al. | |
| 2010/0234201 | A1 | 9/2010 | Little et al. | |
| 2010/0236117 | A1 | 9/2010 | Mestres Armengol et al. | |
| 2011/0011922 | A1 | 1/2011 | Little | |
| 2012/0012734 | A1 | 1/2012 | Tzuo | |
| 2012/0267284 | A1 | 10/2012 | Thimmesch et al. | |
| 2013/0026060 | A1 | 1/2013 | Moss et al. | |
| 2013/0213915 | A1 | 8/2013 | Pfeifer et al. | |
| 2013/0284799 | A1 | 10/2013 | Hallam et al. | |
| 2014/0061288 | A1 | 3/2014 | Dashe | |
| 2016/0075465 | A1 | 3/2016 | Wiley | |
| 2016/0144994 | A1 | 5/2016 | Flaming | |
| 2017/0217633 | A1 | 8/2017 | Lundius | |
| 2017/0247136 | A1 | 8/2017 | Frost | |
| 2017/0354272 | A1 | 12/2017 | Frost | |
| 2018/0127148 | A1 | 5/2018 | Kuhn et al. | |
| 2018/0194515 | A1 | 7/2018 | Valentini et al. | |
| 2018/0229917 | A1 | 8/2018 | Jobe | |
| 2019/0112095 | A1 | 4/2019 | Swarnaraj et al. | |

FOREIGN PATENT DOCUMENTS

| | | | |
|---|---|---|---|
| DE | 3924930 | A1 | 2/1990 |
| FR | 2380129 | A1 | 9/1978 |
| GB | 1188834 | A | 4/1970 |

OTHER PUBLICATIONS

"Final Office Action Received for U.S. Appl. No. 15/596,381 dated Jul. 15, 2019, p. 8.".
"Final office action received for U.S. Appl. No. 13/955,925 dated Jul. 15, 2015".
"Non-Final Office Action Received for U.S. Appl. No. 15/596,381 dated Sep. 14, 2017".
"Non-Final Office Action Received for U.S. Appl. No. 15/596,381 dated Oct. 10, 2018".
"Non-Final office action received for U.S. Appl. No. 13/955,925 dated Oct. 7, 2014".
"Notice of Allowance Received for U.S. Appl. No. 14/997,685 dated Feb. 17, 2017".
"Notice of allowance received for U.S. Appl. No. 13/955,925 dated Sep. 11, 2015".
"Notice of Allowance received for U.S. Appl. No. 15/596,381, dated Jan. 10, 2020, p. 8", 8.
"Advisory Action Received For U.S. Appl. No. 15/687,791 dated Nov. 14, 2019, 4 Pages."
"Advisory Action Received For U.S. Appl. No. 15/687,791 dated Oct. 28, 2019, 4 Pages."
"English translation of FR 2380129 A1", Sep. 8, 1978.
"Final Office Action received for U.S. Appl. No. 15/687,791, dated Aug. 8, 2019, 15 Pages", 15.
"Non Final Office Action Received For U.S. Appl. No. 15/687,791 dated Jan. 2, 2019, 24 Pages."
"Non-Final office action received for U.S. Appl. No. 14/595,988 dated Apr. 20, 2016,9 Pages"
"Notice of Allowance received for U.S. Appl. No. 15/687,791, dated Mar. 9, 2020, 5 pages"
"Notice of Allowance Received for U.S. Appl. No. 14/595,988 dated Apr. 24, 2017,12 Pages"
U.S. Appl. No. 14/595,988 , "Final Office Action received for U.S. Appl. No. 14/595,988, dated Jan. 12, 2017,14 Pages", Jan. 12, 2017.
"Non-Final office action received for U.S. Appl. No. 14/216,274 dated Jun. 17, 2016".
"Notice of Allowance Received for U.S. Appl. No. 15/912,180, dated Mar. 19, 2020."
"Notice of Allowance Received for U.S. Appl. No. 15/369,574, dated Oct. 24, 2017."
"Notice of Allowance received for U.S. Appl. No. 14/216,274 dated Oct. 24, 2016".
"Restriction Requirement Received for U.S. Appl. No. 15/912,180 dated Nov. 5, 2019."

* cited by examiner

BOX CONTAINER AND DISPLAY

CROSS-REFERENCE TO RELATED APPLICATIONS

This application is a continuation-in-part application of each of the following:

U.S. patent application Ser. No. 15/596,381, filed May 16, 2017, now U.S. Pat. No. 10,647,468, which is a continuation application of U.S. patent application Ser. No. 14/997,685, filed Jan. 18, 2016, now U.S. Pat. No. 9,682,795, which is a continuation application of U.S. patent application Ser. No. 13/955,925, filed Jul. 31, 2013, now U.S. Pat. No. 9,238,523, which claims priority benefit, with regard to all common subject matter, of earlier-filed U.S. Provisional Patent Application No. 61/677,979, filed Jul. 31, 2012, and entitled "IMPROVED STACKABLE TRAY," the entire disclosures of which are incorporated herein by reference.

U.S. patent application Ser. No. 16/505,137, filed on Jul. 8, 2019, which is a continuation application of U.S. patent application Ser. No. 15/960,338, filed Apr. 23, 2018, now U.S. Pat. No. 10,342,365, which is a continuation application of U.S. patent application Ser. No. 13/955,865, filed Jul. 31, 2013, now U.S. Pat. No. 9,949,579, which claims priority benefit, with regard to all common subject matter, of earlier-filed U.S. Provisional Patent Application No. 61/677,966, filed Jul. 31, 2012, and entitled "TRIFEED HUTCH SHELF," the entire disclosures of which are incorporated herein by reference.

U.S. patent application Ser. No. 15/952,928, filed Apr. 13, 2018, which is a continuation application of U.S. patent application Ser. No. 14/679,586, filed Apr. 6, 2015, now U.S. Pat. No. 9,947,245, which is a continuation application of U.S. patent application Ser. No. 13/955,811, filed Jul. 31, 2013, now U.S. Pat. No. 8,997,388, which claims priority benefit, with regard to all common subject matter, of earlier-filed U.S. Provisional Patent Application No. 61/677,937, filed Jul. 31, 2012, and entitled "FACETED CORRUGATED SIGNAGE," the entire disclosures of which are incorporated herein by reference.

U.S. patent application Ser. No. 16,520,270, filed Jul. 23, 2019, which is a continuation application of U.S. patent application Ser. No. 15/956,575, filed Apr. 18, 2018, now U.S. Pat. No. 10,390,634, which is a continuation application of U.S. patent application Ser. No. 15/363,256, filed Nov. 29, 2016, now U.S. Pat. No. 9,986,856, which is a continuation application of U.S. patent application Ser. No. 14/968,352, filed Dec. 14, 2015, now U.S. Pat. No. 9,578,978, which is a continuation application of U.S. patent application Ser. No. 14/146,130, filed Jan. 2, 2014, now U.S. Pat. No. 9,212,019, which claims priority benefit, with regard to all common subject matter, of earlier-filed U.S. Provisional Patent Application No. 61/748,672, filed Jan. 3, 2013, and entitled "MODULAR GREETING CARD RACK," the entire disclosures of which are incorporated herein by reference.

U.S. patent application Ser. No. 15/912,180, filed Mar. 5, 2018, which is a continuation application of U.S. patent application Ser. No. 15/369,574, filed Dec. 5, 2016, now U.S. Pat. No. 9,908,663, which is a continuation application of U.S. patent application Ser. No. 14/216,274, filed Mar. 17, 2014, now U.S. Pat. No. 9,511,899, which claims priority benefit, with regard to all common subject matter, of earlier-filed U.S. Provisional Patent Application No. 61/793,340, filed Mar. 15, 2013, and entitled "ONE PIECE PALLET SKIRT," the entire disclosures of which are incorporated herein by reference.

U.S. patent application Ser. No. 16/236,920, filed Dec. 31, 2018, which is a continuation application of U.S. patent application Ser. No. 15/790,692, filed Oct. 23, 2017, now U.S. Pat. No. 10,170,021, which is a continuation application of U.S. patent application Ser. No. 14/840,417, filed Aug. 31, 2015, now U.S. Pat. No. 9,799,239, which is a continuation application of U.S. patent application Ser. No. 14/216,721, filed Mar. 17, 2014, now U.S. Pat. No. 9,123,262, which claims priority benefit, with regard to all common subject matter, of earlier-filed U.S. Provisional Patent Application No. 61/791,437, filed Mar. 15, 2013, and entitled "FACETED CORRUGATED SIGNAGE," the entire disclosures of which are incorporated herein by reference.

U.S. patent application Ser. No. 15/687,791, filed Aug. 28, 2017, which is a continuation application of U.S. patent application Ser. No. 14/595,988, filed Jan. 13, 2015, now U.S. Pat. No. 9,743,782, which claims priority benefit, with regard to all common subject matter, of earlier-filed U.S. Provisional Patent Application No. 61/926,805, filed Jan. 13, 2014, and entitled "RETAIL UPRIGHT SHELF EXTENDER," the entire disclosures of which are incorporated herein by reference.

FIELD OF THE INVENTION

Embodiments of the present invention relate generally to the field of point of purchase merchandise shipping and display containers. More particularly, embodiments of the present invention relate to a corrugated, paperboard container and display that is manufactured in a fold and glue assembly process and that is traditionally provided to an end user in a collapsed or knockdown configuration for setup.

BACKGROUND

Corrugated containers are made from pieces of flat paperboard stock material that are die cut into shapes that define various panels. The shapes are folded along predefined lines between the panels with at least one overlapping strip or panel that is glued, taped or otherwise affixed to another panel to form an enclosed boundary. The panels are folded and/or glued into place to become the walls of the container. The containers are traditionally provided to product manufacturers and/or retailers in a collapsed or knock-down configuration for storage, handling and shipping. The manufacturer and/or retailers open the knockdown containers and fold appropriately to utilize the assembled container for packing and/or displaying products therein.

The knockdown containers are typically manufactured by feeding flat die cut sheets through a fold-and-glue machine. The fold-and-glue machine applies adhesive and folds over select panels so that the panels are in the knock-down configuration. One common knock-down container is an open-top style box container. An open-top style box container is typically used to ship products to retailers, who can then display the products to consumers at the retailer's point-of-sale location. It is desirable to minimize the time and effort necessary for retailers to assemble a container from its knock-down configuration. Thus, such container suppliers typically attempt to design containers that do not require separate discrete parts such as reinforcing inserts or dividers. However, in circumstances in which heavy products are being displayed in the containers, it is often necessary to utilize separate metal supports and/or corrugated support dividers to handle the heavy load. This adds considerably to the assembly labor as well as material costs for the container. Furthermore, other circumstances may require the containers to transport and secure fragile items. Standard open-top style box containers are generally not appropriate for handling such fragile items because the open-top does not provide the security required for the fragile items.

An example of such an open-top style box container is shown and described in U.S. Pat. No. 7,981,017 (the '017 patent"), the entire disclosure of which is incorporated herein by reference. However, the container disclosed in the '017 patent is not configured to handle heavy loads or to maintain fragile items therein. Therefore, it would be beneficial to provide a box container that can accommodate heavier product loads without requiring additional support members and that can support fragile items safely during transport and display.

SUMMARY

Embodiments of the present invention include a corrugated box container with a main component including a base section and first and second side sections. The box container additionally includes first and second side support components associated with the first and second side sections for reinforcing the first and second side support sections. The box container further includes a cover component that can be engaged with the main component or the first and second side support components, such that the main component and the cover component present a fully enclosed space within the box container.

Embodiments of the present invention additionally include a method for making a corrugated box container, with the method including the initial step of forming a main component that includes a base section opposed on sides by a first side section and a second side section. The next step includes forming fold lines between the first side section and the base section and between the second side section and the base section. The method additionally includes the step of forming side support components that can be associated with each of the first and second side sections of the main component to reinforce the side sections. The method includes the final step of forming a cover component operable to be engaged with the main component or the first and second side support components so as to fully enclose a space within the box container.

Embodiments of the present invention additionally include a method of erecting a corrugated box container, with the method including providing the box container in a knockdown configuration, with the box container having a main component comprising a base section opposed by first and second side sections, first and second side support components, and a cover component. The method includes folding the first and second side sections until the side sections are generally perpendicular with the base section. The method includes the next step of connecting the first and second side support components with the first and second side sections respectively, such that the support components are operable to reinforce the side sections. Finally, the method includes the step of connecting the cover component with the main component or the first and second side support components so as to provide a fully enclosed space within the box container.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

Embodiments of the present invention are described in detail below with reference to the attached drawing figures, wherein.

Figure 1:
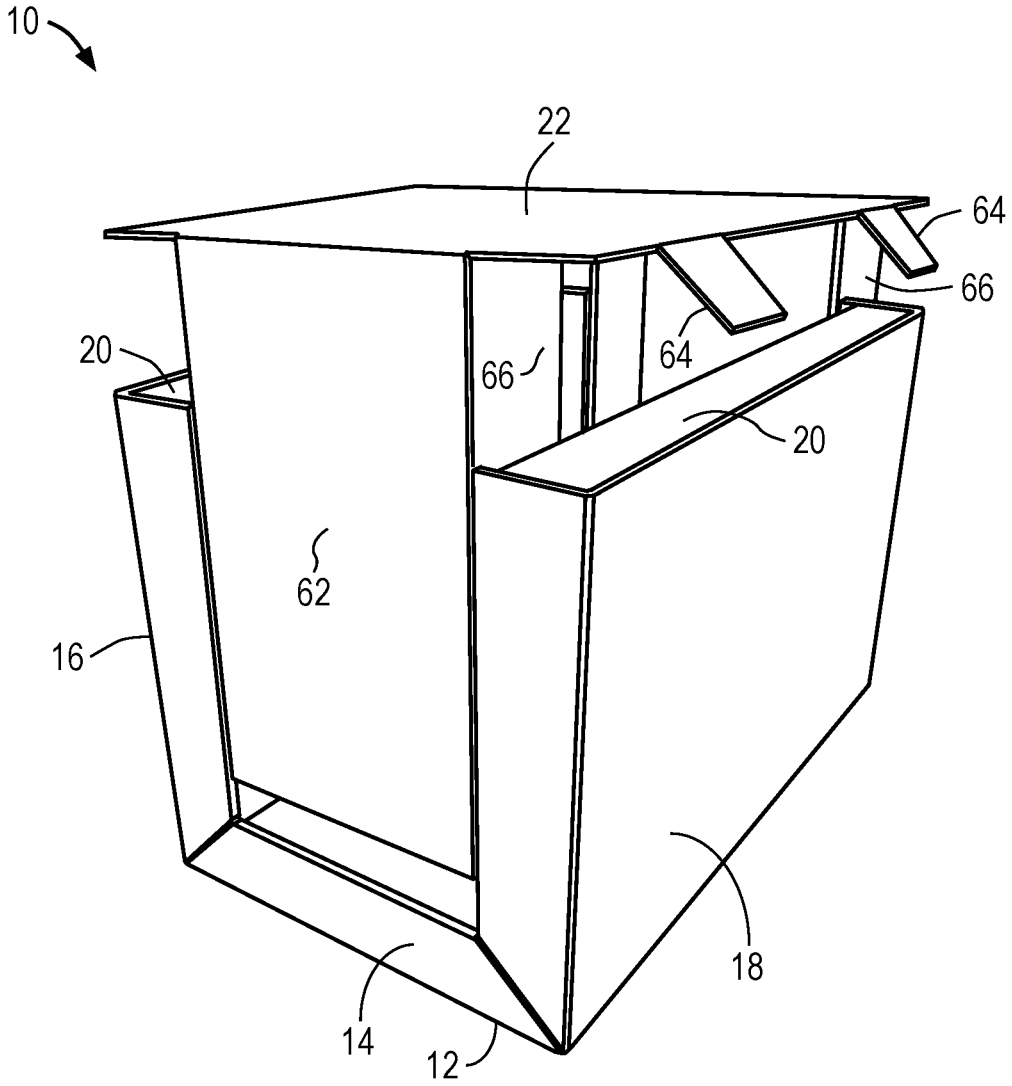
FIG. 1 is a perspective view of the box container according to embodiments of the present invention, with the box container including a main component, two side support components, and a cover component.
Figure 2:
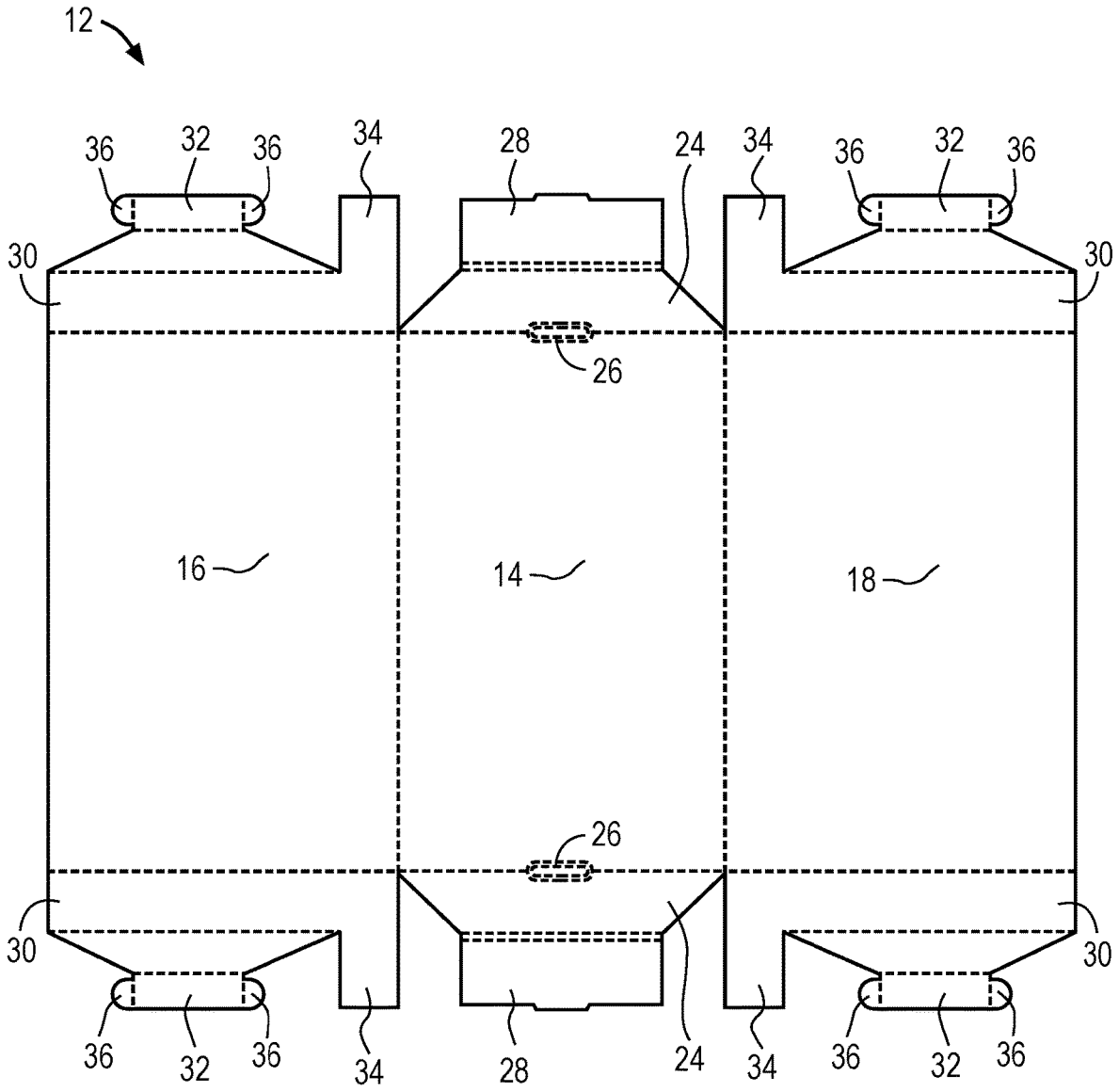
FIG. 2 is a perspective view of the main component from FIG. 1 in a knockdown configuration.
Figure 3:
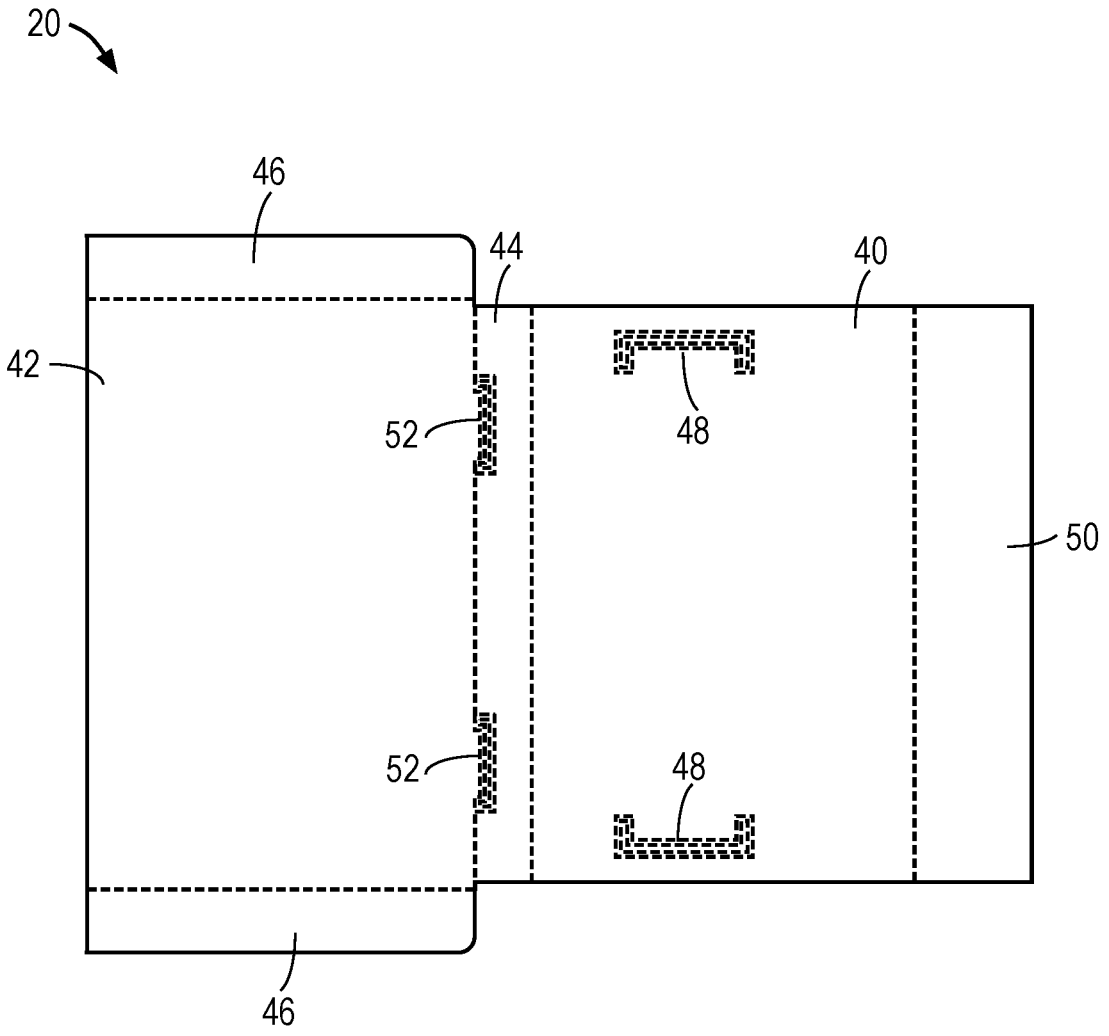
FIG. 3 is a perspective view of one of the side support components from FIG. 1 in a knockdown configuration.
Figure 4:
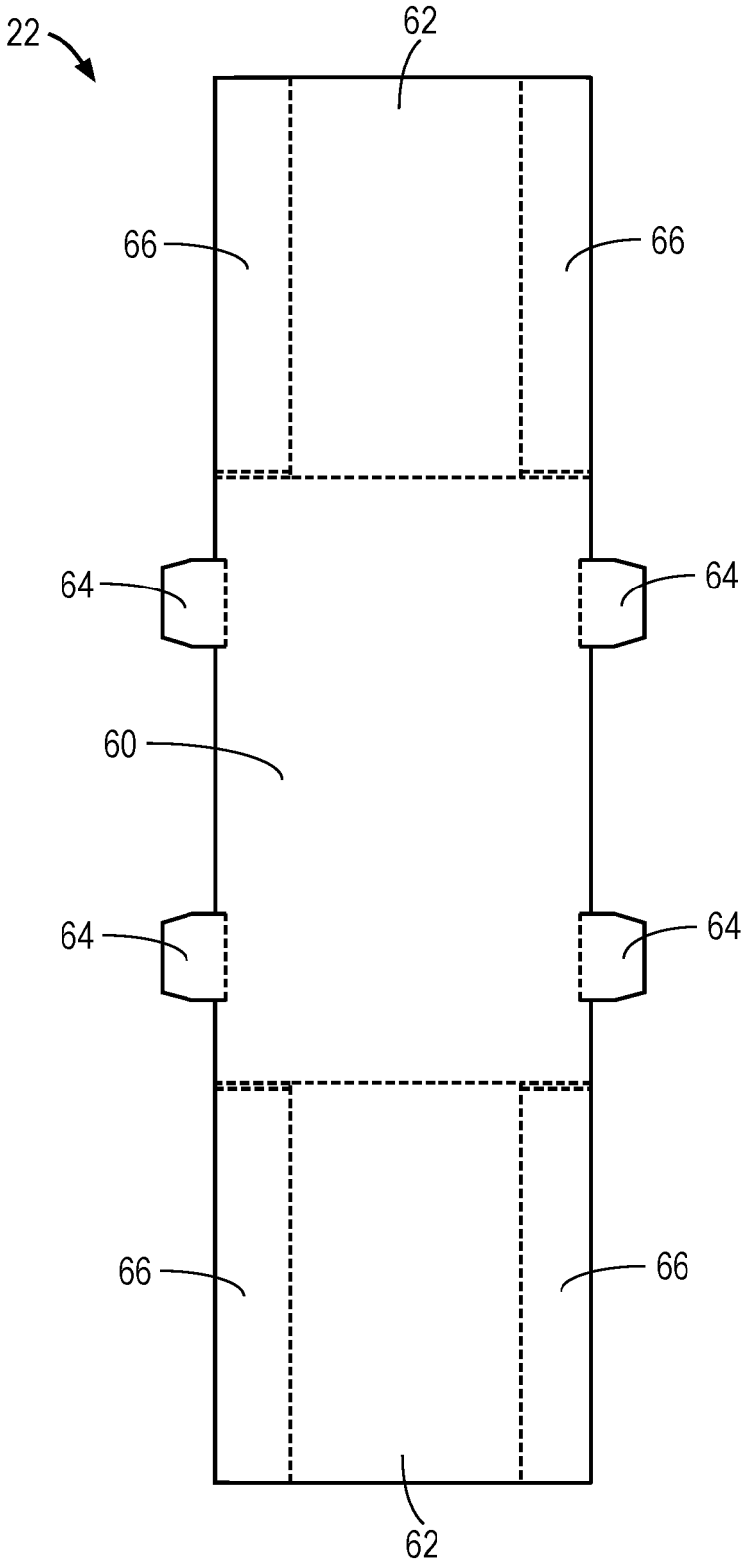
FIG. 4 is a perspective view of the cover component from FIG. 1 in a knockdown configuration.
Figure 5:
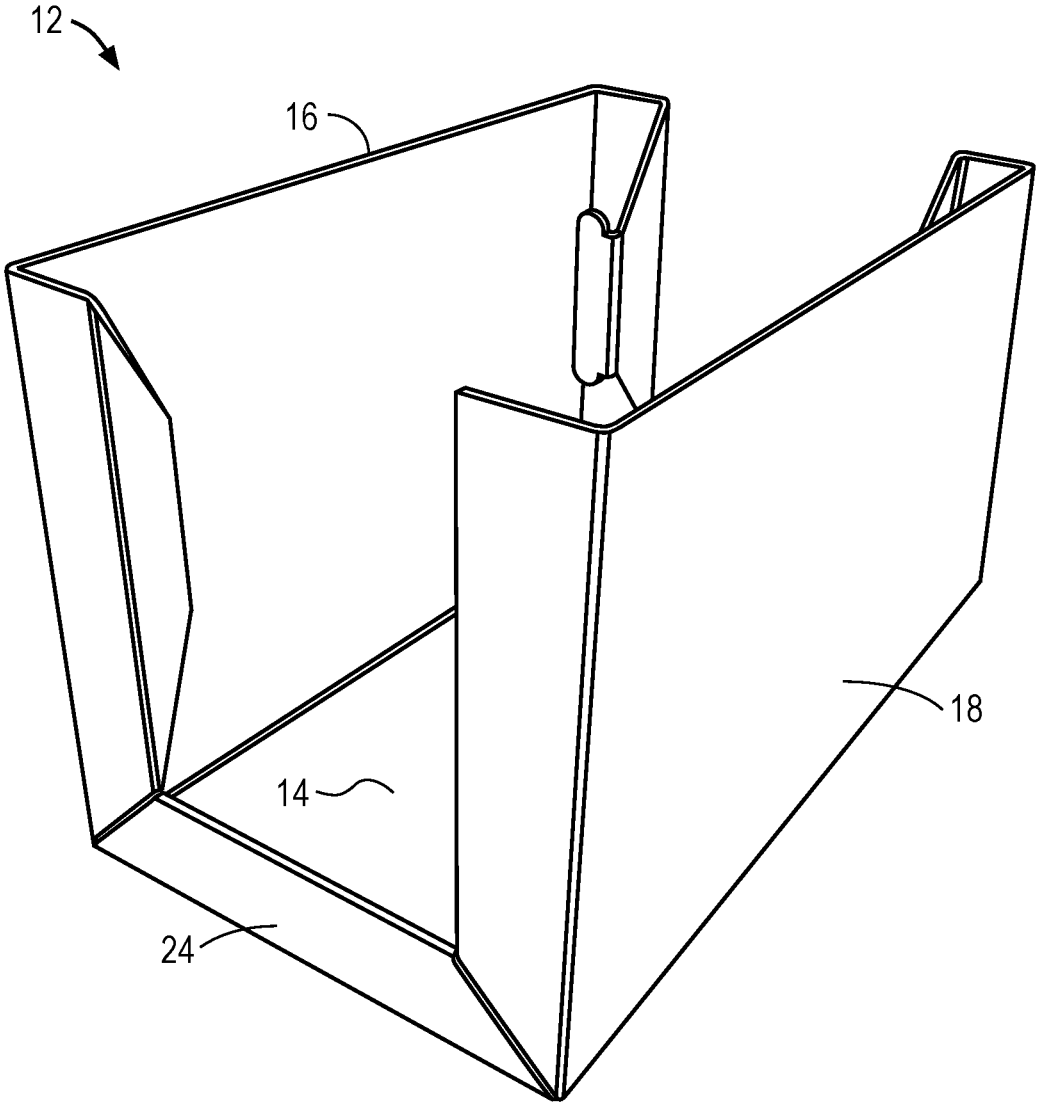
FIG. 5 is a perspective view of the main component from FIGS. 1 and 2 in an erected configuration.
Figure 6:
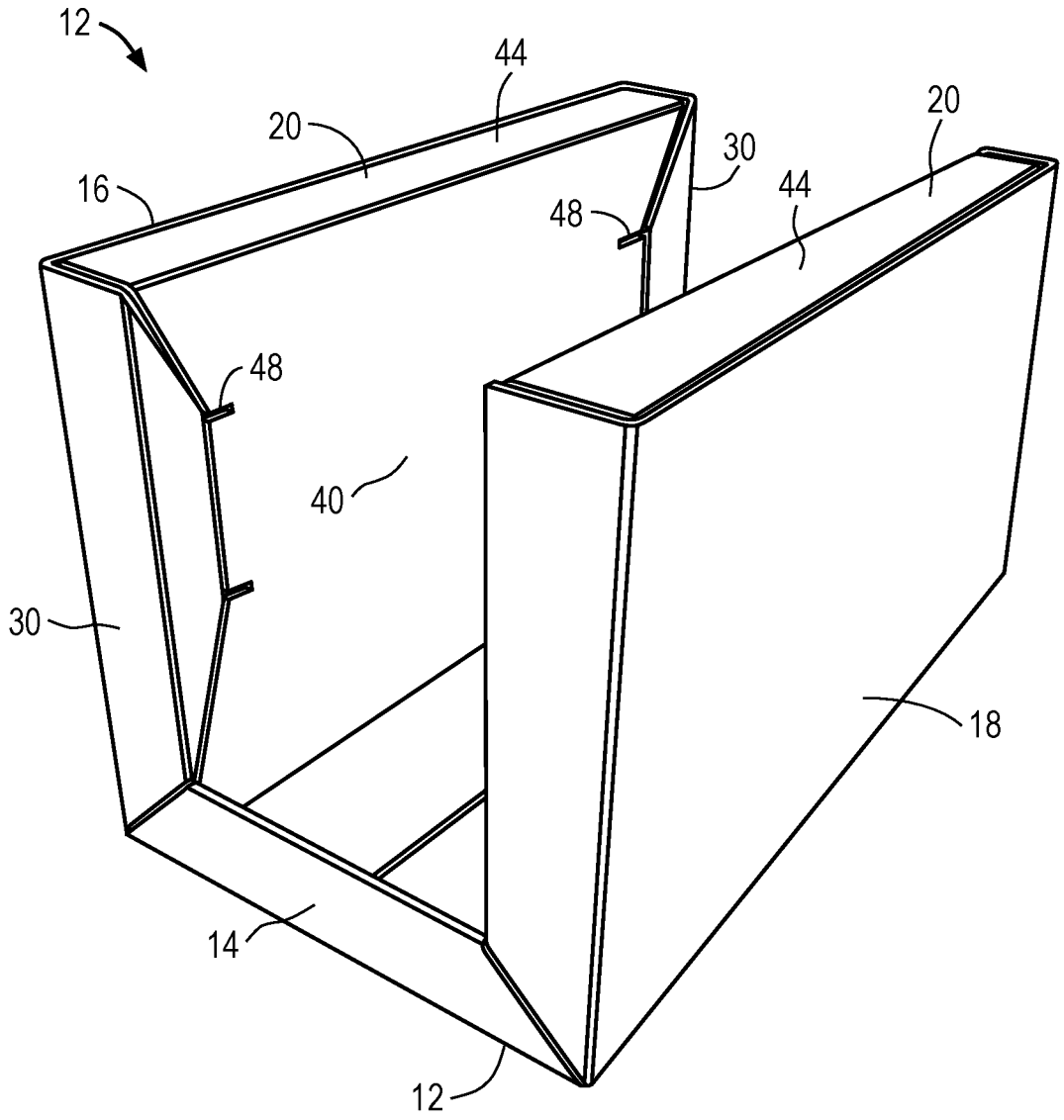
Figure 7:
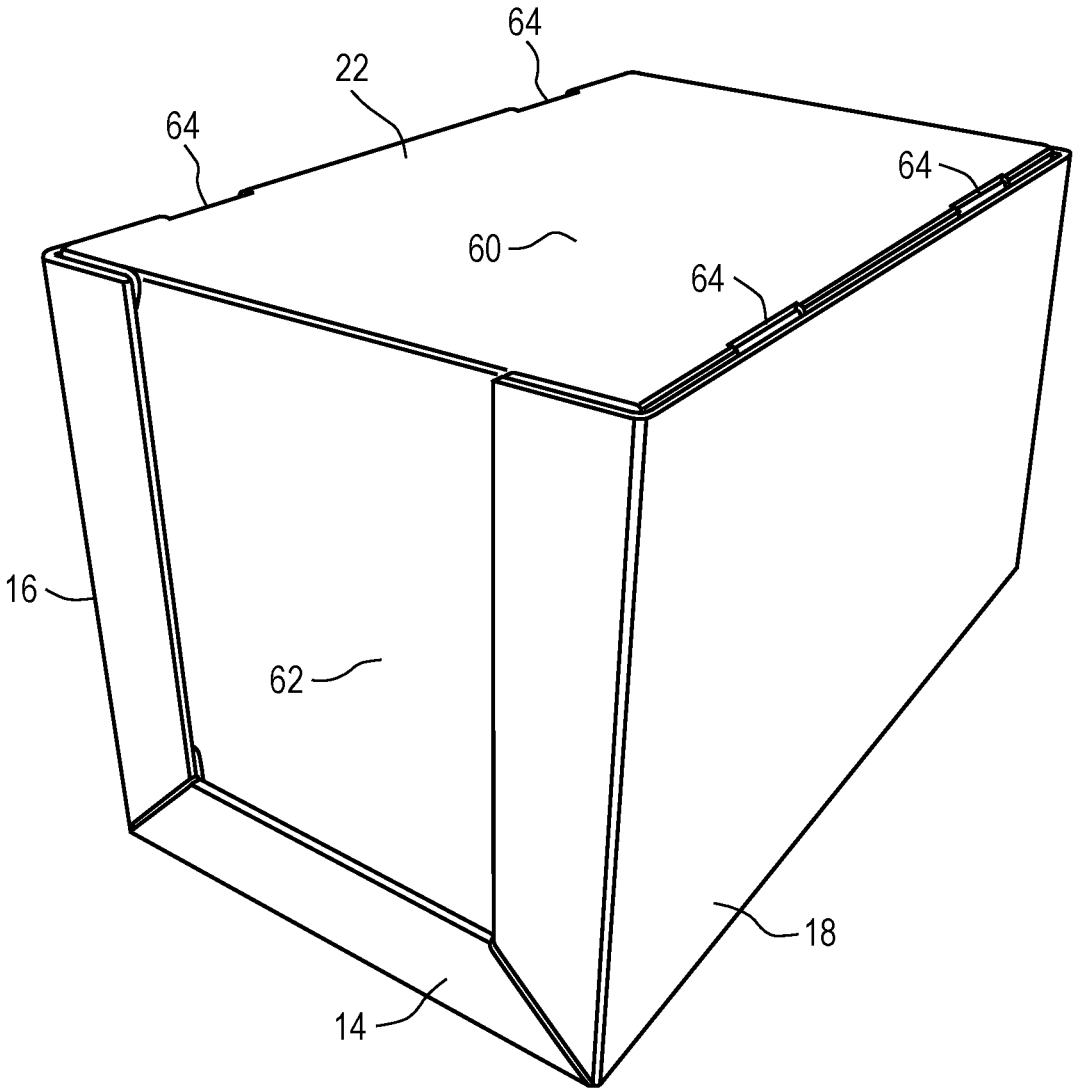

FIG. 6 is a perspective view of the main component from FIGS. 1, 2, and 5 with two side support components from FIGS. 1, and 3 secured thereto, each in an erected configuration; and FIG. 7 is a perspective view of the main component from FIGS. 1, 2, 5 and 6 with the two side support components from FIGS. 1, 3, and 6 secured thereto, and further including the cover component from FIGS. 1 and 4 secured thereto, all in an erected configuration.

APPENDIX A includes a copy of one issued patent from each of the seven patent families associated with this continuation-in-part application.

The drawing figures do not limit the present invention to the specific embodiments disclosed and described herein. The drawings are not necessarily to scale, emphasis instead being placed upon illustrating the principles of the invention.

DETAILED DESCRIPTION

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

As shown in FIG. 1, embodiments of the present invention include a box container 10 that includes a main component 12 having a base section 14 opposed by a first side section 16 and a second side section 18; side support components 20 operable engage with the first side section and the second side section of the main component; and a cover component 22 operable engage with portions of the first and second side support sections and to act as a cover for the box container. In some embodiments, the box container 10 is initially be produced in a knockdown configuration (i.e., a generally flat, two-dimensional form), such as illustrated in FIGS. 2-4. From the knockdown configuration, the box container 10 is transformed into the erected configuration shown in FIG. 1. When in the erected configuration, the box container 10 is operable to securely hold heavy and/or fragile items, and to support such items through transportation and/or shipping. In some embodiments, the box container 10 is formed from one or more sections of corrugated material. In some embodiments, such corrugated material includes paperboard. However, other embodiments provide for the corrugated material to include other similar type materials, such as cardboard, fiberboard, or the like.

Turning to FIG. 2, and as described above, the main component 12 of the box container 10 of embodiments of the present invention has three primary sections, including the base section 14 opposed by first and second side sections 16,18. The main component 12 has thereon fold lines along which in some embodiments can be weakened, or in other embodiments, caused preferentially to fold by any of various means. For example, in some embodiments the corrugated material is compressed along a thin line defining a fold line. In other embodiments the corrugated material is cut part way through along the line, or cut all or part way through the line at spaced intervals. Thus, each of the first and second side sections 16,18 in some embodiments are separated from the base section by fold lines. As such, each of the first and second side sections 16,18 in some embodiments are operable to rotate or fold with respect to the base section 14. For illustrative purposes, the fold lines of the box container 10 are illustrated by single dotted lines in the attached drawings, and are particularly illustrated in FIGS. 2-4.

Remaining with FIG. 2, the base section 14 of the main component 12 generally includes a rectangular or square-shaped central section and two lip sections 24 connected with the rectangular or square-shaped section via fold lines. As such, each of the lip sections 24 in some embodiments is operable to be rotate or fold with respect to the central section. In some embodiments, such fold lines each additionally include one or more slits 26, cutouts, and/or slots extending down a portion thereof. The lip sections 24 in some embodiments include one or more tabs 28. Remaining with FIG. 2, the base section 14 further includes the first and second side sections 16,18, which each include two end portions 30 connected with the side sections via fold lines. As such, each of the end portions 30 in some embodiments are operable to rotate or fold with respect to the side sections 16,18 to which they are attached. The end portions 30 in some embodiments each include main tabs 32 and side tabs 34 that function to secure the box container 10 in an erected position, as will be discussed in more detail below. The tabs 32 in some embodiments include tab fingers 36 that extend from sides of the tabs and that operate to secure the tabs 32 within a corresponding opening (e.g., a cutout), as will be discussed in more detail below.

Turning to FIG. 3, the side support components 20 each include an inner panel 40 and an outer panel 42, with the inner and outer panels separated by a central panel 44 via fold lines. As such, each of the inner and outer panels 40,42 in some embodiments are operable rotate or fold with respect to the central panel 44. In certain embodiments, the inner and outer panels 40,42 have shapes and sizes that generally correspond to the shape and size of the side sections 16,18 of the main component 12. In certain embodiments, the outer panel 42 includes two flange sections 46 that are each operable to fold along fold lines. The inner panel 40 includes two openings 48 in the form of slits or notch-shaped cutouts. In certain embodiments, the inner panel 40 includes a single flange section 50 that extends from a side of a main portion of the inner panel opposite the central panel 44. Further, the central panel 44 includes two openings 52 in the form of slits or notch-shaped cutouts. As will be discussed in more detail below, the openings 48 of the inner panel 40 are used in some embodiments for mating with tabs 32 of the main component 12, and the openings 52 of the central panel 44 are used with portions of the cover component 22 so as to secure the box container 10 in an erected configuration.

With reference to FIG. 4, in certain embodiments, the cover component 22 of the box container 10 includes a top section 60 and end sections 62, with the end sections separated from the top section by fold lines. As such, each of the end sections 62 is operable to rotate or fold with respect to the top section 60. In certain embodiments, the top section 60 has a size and a shape that corresponds to the size and shape of the central section of the base section 14 of the main component 12. The top section 60 in some embodiments has four main tabs 64, with two tabs being positioned on each side of the top section. The end sections 62 in some embodiments each include two flange sections 66 positioned on sides of the end sections and separated from main portions of the end sections via fold lines. As such, each of flange sections 66 are operable to rotate or fold with respect to the main portions of the end sections 60. The four main tabs 64 and the flange sections 66 are operable to secure the box container 10 in an erected position, as will be discussed in more detail below.

In operation of embodiments of the present invention, the box container 10 is transformed in a quick and efficient manner from the knockdown configuration of FIGS. 2-4 to the erected configuration of FIG. 1. To begin, and with reference to FIG. 5, the first and second side sections 16,18 of the main component 12 are folded in along their fold lines until the side section are generally parallel with each other and are generally perpendicular with the base section 14. Next, the lip sections 24 are folded about the fold lines connecting the lip sections with the central section of the base section 14 until the lip sections are orientated generally perpendicularly with the central section. As such, the tabs 28 (not shown in FIG. 5) are capable of being inserted within the slits 26 (not shown in FIG. 5) to secure the lip sections 24 in place. In addition, the side tabs 34 (not shown in FIG. 5) of the end portions 30 (not shown in FIG. 5) of the side sections 16,18 are capable of being inserted between a portion of the lip sections 24 that were folded together, such that the side sections are secured in position that is generally perpendicular to the base section 14. In certain embodiments, the first and second side sections 16,18 are secured via frictional forces imparted between the lip sections 24 and the side tabs 34. In other embodiments, the side tabs 34 are secured to the lip sections 24 via an adhesive, such as glue, tape, or the like. As such, the main component 12 is erected to present a box-shaped container that includes a base and two side sections.

With reference to FIG. 6, in the embodiment shown, the two side support components 20 are secured to the main component 12 to reinforce each of the first and second side sections 16,18. In more detail, the inner and outer panels 40,42 (outer panel not shown in FIG. 6) of each of the side support components 20 are folded about the central panel 44 until the inner and outer panels are generally parallel with each other and perpendicular to the central panel. As such, the outer panel 40 of a first side support component 20 in the embodiment shown is positioned adjacent to an interior-facing surface of the first side section 16 of the main component 12. Similarly, in the embodiment shown, the outer panel 40 of a second side support component 20 is positioned adjacent to an interior-facing surface of the second side section 18 of the main component 12. Next, in the embodiments shown, the end portions 30 of the first and second side sections 16,18 are wrapped around the side support components 20, and each the main tabs 32 (not shown in FIG. 6) of the end portions are mated within the openings 48 of the inner panels 40 of the side support components. In certain embodiments, before the main tabs 32 are inserted within the openings 48, the tab fingers 36 (not shown in FIG. 6) are folded against the remaining portions of the main tabs 32. Once the main tabs 32 have been inserted, the tab fingers 36 are capable of unfolding, thus securing the main tabs within the openings 48. As such, the side support components 20 are secured in place to the main component 12 and are operable to reinforce the side sections 16,18 of the main component.

Finally, with reference to FIGS. 1 and 7, in the embodiment shown, the cover component 22 is arranged into position by folding the end sections 62 about the fold lines until the end sections are generally parallel with respect to each other and perpendicular to the top section 60. Next, the flange sections 66 (not shown in FIG. 7) of the end sections are folded about their fold lines until they are generally perpendicular to their respective end section 62. As such, the cover component 22 is capable of being secured to the remaining components of the box container 10, so as to provide a top cover and end covers for securely enclosing a space within the box container. In particular, the end sections 62 are capable of being positioned between the first and second side sections 16,18, such that the flange sections 66 of the end sections are adjacent to the inner panels 40 of the side support components 20 (not shown in FIG. 7). As such, the flange sections 66 are operable to provide frictional support to secure the cover component 22 in place. Further, the four main tabs 64 of the cover component 22 are mated with the openings 52 (not shown in FIGS. 1 and 7) on the central section 44 of each of the side support components 20. Such mating further provides for the cover component 22 to be secured in place, such as illustrated by FIG. 7.

With the box container 10 in an erected configuration as described above, the box container is operable to provide a reinforced, enclosed container that is capable of securely holding fragile items during shipping or transportation. Because the box container 10 includes the side support components 20 and the cover component 22, the box container is reinforced to protect the container, and the items stored therein, from external forces. Furthermore, the side support components 20 and cover component 22 are operable to provide an enclosed area within the box container 10, such that items included within the box container are protected from the elements during shipping or other transportation. Furthermore, because the box container 10 is reinforced and has all sides covered, multiple box containers can be stacked on top of each other to facilitated efficient use of space. Furthermore, once the box container 10 has reached its intended destination, the cover component 22 is removed from the remaining components of the box container, and the remaining components are used to display the items that were enclosed therein. Thus, embodiments of the present invention provide for the box container 10 to be used to securely transport items, and further to display such items after transport.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A corrugated box container moveable between a shipping configuration and a display configuration, the shipping configuration of the container comprising:

a main component having opposed left and right side portions;

opposing first and second side support components, each side component secured to at least one of the left and right side portions, wherein said left and right side portions of said main component define respective left and right walls, wherein said main component defines an inner area having an open top extending between said left and right top surfaces and extending between the opposing first and second side support components, wherein each of said opposing first and second side support components includes a plurality of openings, wherein the container is movable from a shipping configuration to an upright configuration, and wherein said plurality of openings are configured to support the configuration of the container when the container is in the upright configuration; and opposed left and right flange sections extending from respective left and right edges of said left and right side portions, each of said left and right side flanges being generally perpendicular to said left and right side portions, respectively, when the container is in the upright configuration, wherein the flange sections secure opposing first and second side support components relative to said left and right side portions when the container is the upright configuration.

2. The container of claim 1, wherein said right side portion defines an inner surface extending upwards from an inner edge of a bottom surface, an outer surface of said right side flange being mated against said inner surface of said left side portion when the container is in the upright configuration.

3. The container of claim 2, wherein said left side portion defines an inner surface extending upward from an inner edge of a bottom surface, an outer surface of said left side flange section being mated against said inner surface of said left side portion when the container is in the upright configuration.

4. The container of claim 3, wherein said left and right flange sections are operable to rotate with respect to the left and right side portions, respectively.

5. The container of claim 1, wherein said openings are bounded on at least four sides when the container is in the shipping configuration.

6. A method of forming a corrugated box container moveable between a shipping configuration and an upright configuration, the method comprising:

forming a main component having opposed left and right side portions;

forming opposing first and second side support components, each side component secured to at least one of the left and right side portions, wherein said left and right side portions of said main component define respective left and right walls, wherein said main component defines an inner area having an open top extending between said left and right top surfaces and extending between the opposing first and second side support components, wherein each of said opposing first and second side support components includes a plurality of openings, wherein the container is movable from a shipping configuration to an upright configuration, and wherein said plurality of openings are configured to support the configuration of the container when the container is in the upright configuration; and forming opposed left and right flange sections, said left and right flange sections extending from respective left and right edges of said left and right side portions, each of said left and right side flanges being generally perpendicular to said left and right side portions, respectively, when the container is in the upright configuration, wherein the flange sections secure opposing first and second side support components relative to said left and right side portions when the container is the upright configuration.

7. The method of claim 6, said right side portion defines an inner surface extending upwards from an inner edge of a bottom surface, an outer surface of said right side flange being mated against said inner surface of said left side portion when the container is in the upright configuration.

8. The container of claim 7, wherein said left side portion defines an inner surface extending upward from an inner edge of a bottom surface, an outer surface of said left side flange section being mated against said inner surface of said left side portion when the container is in the upright configuration.

9. The method of claim 8, wherein said left and right flange sections are operable to rotate with respect to the left and right side portions, respectively.

10. The method of claim 6, wherein said openings are bounded on at least four sides when the container is in the shipping configuration.

* * * * *